US005169101A

United States Patent [19]

Wenzel et al.

[11] Patent Number: 5,169,101

[45] Date of Patent: Dec. 8, 1992

[54] RACK FOR COLLECTING RECYCLABLE MATERIALS

[75] Inventors: Richard Wenzel, Pittsford; Louis E. Sable, Rochester, both of N.Y.

[73] Assignee: Mobil Oil Corporation, Fairfax, Va.

[21] Appl. No.: 708,657

[22] Filed: May 31, 1991

[51] Int. Cl.[5] ..... A63B 55/04

[52] U.S. Cl. ..... 248/97; 248/95; 248/99

[58] Field of Search ..... 248/97, 95, 99, 100, 248/98; 211/181, 189, 12

[56] References Cited

U.S. PATENT DOCUMENTS

| | | | |
|---|---|---|---|
| 2,600,191 | 6/1952 | Beach | 211/181 X |
| 3,806,146 | 4/1974 | Shaw | 248/95 X |
| 3,934,894 | 1/1976 | Hoeffken et al. | 280/47 |
| 4,339,099 | 7/1982 | Barton et al. | 248/101 |
| 4,487,388 | 12/1984 | Provan | 248/97 |
| 4,623,111 | 11/1986 | Prader | 248/97 |
| 4,762,297 | 8/1988 | Milligan | 248/99 |
| 4,783,031 | 11/1988 | Ebentheuer | 248/97 |
| 4,957,252 | 9/1990 | Watkins | 248/97 |
| 5,033,703 | 7/1991 | Allen, Sr. | 248/95 X |

*Primary Examiner*—Blair M. Johnson
*Attorney, Agent, or Firm*—Alexander J. McKillop; Charles J. Speciale; Michael J. Mlotkowski

[57] ABSTRACT

A rack for supporting flexible bags in an open condition. The rack includes first and second wire side members each having at least two upwardly standing spaced elongated wire members having an upper end and a lower end, a rim member integrally connected to the upper ends of the upwardly standing elongated wire members, and a side retaining member integrally connected to the lower ends of the upwardly standing elongated wire members; and a base having a first end and a second end, the base comprising at least two spaced longitudinally disposed wire members each having an upper tangential surface and a lower tangential surface, a plurality of upper base members each affixed at opposite ends thereof in a substantially perpendicular relationship to the upper tangential surfaces of the longitudinally disposed wire members and a plurality of lower base members each affixed at opposite ends thereof in a substantially perpendicular relationship to the lower tangential surfaces of the longitudinally disposed wire members, the first and second ends of the base each having an upper base member and a lower base member positioned so as to define an opening at each of the first and second ends effective to position the side retaining members of the first and second wire side members therethrough.

19 Claims, 7 Drawing Sheets

RACK FOR COLLECTING RECYCLABLE MATERIALS

FIELD OF THE INVENTION

The present invention relates generally to racks for supporting flexible bags in an open condition and, and more particularly to an improved rack design for use in the collection of recyclable materials.

BACKGROUND OF THE INVENTION

Although expendable thermoplastic grocery bags, packaging materials, cups and containers are preferred by consumers and suppliers alike for a wide variety of reasons, concern is mounting over the disposal of such articles as landfill space becomes increasingly scarce. These articles have been cited as making up a significant portion of our solid waste stream and, as a result of this, greater emphasis is now being placed on the recycling of these materials as an important means of reducing our solid waste load.

One change in recent years is the increased consumer preference for plastic grocery sacks. It has been estimated that plastic grocery sacks account now for at least 60 percent of the grocery sack market. The increase in preference stems from several factors including ease in use for the consumer and lower cost to the provider. Plastic grocery sacks also require one-tenth the landfill space upon disposal therein. However, even more important benefits can be realized when the fact that thermoplastic grocery sacks are recyclable and can be reused to form useful plastic products.

Supermarket chains today, in association with plastic grocery sack producers, have begun programs to collect used plastic sacks for recycling. In the usual case, consumers bring their used sacks back to the store where they were obtained, deposit them in a bin or container designated for that purpose, with the store or chain shipping collected sacks back to a plastic sack producer. There the sacks are shredded, formed into pellets, and can be turned into new products.

Virtually any expendable article produced from thermoplastic materials can be recycled. The success of a recycling program is impacted by a variety of factors, including the cleanliness of the articles collected, whether the collected articles were produced from similar resin; e.g. all linear low density polyethylene, rather than a mix of polyethylene and polystyrene and various economic considerations. For example, if foamed polystyrene cups are collected for recycling, it is important that the contents of the cups are emptied prior to being placed in a recycling station.

To aid in the success of any recycling program, it is desirable that recycling stations be easy to identify, assist the consumer through their design to properly deposit articles therein to assure that the collected articles have the potential for being recycled into high value plastic products, be easy to ship at low freight cost to the recycling station user and perhaps more importantly, be easy to assemble and implement by the station user.

Therefore what is needed is a rack for supporting flexible bags in an open condition for use in the collection of recyclable materials.

SUMMARY OF THE INVENTION

In accordance with the present invention, there is provided a rack for supporting flexible bags in an open condition, comprising: a first wire side member having at least two upwardly standing spaced elongated wire members each having an upper end and a lower end, a rim member integrally connected to said upper ends of said upwardly standing elongated wire members extending outwardly therefrom, and a side retaining member integrally connected to said lower ends of said upwardly standing elongated wire members; a second wire side member having at least two upwardly standing spaced elongated wire members each having an upper end and a lower end, a rim member integrally connected to said upper ends of said upwardly standing elongated wire members extending outwardly therefrom, and a side retaining member integrally connected to said lower ends of said upwardly standing elongated wire members; and a base having a first end and a second end, said base comprising at least two spaced longitudinally disposed wire members each having an upper tangential surface and a lower tangential surface, a plurality of upper base members each affixed at opposite ends thereof in a substantially perpendicular relationship to said upper tangential surfaces of said longitudinally disposed wire members and a plurality of lower base members each affixed at opposite ends thereof in a substantially perpendicular relationship to said lower tangential surfaces of said longitudinally disposed wire members, said first and second ends of said base each having an upper base member and a lower base member positioned so as to define an opening at each of said first and second ends effective to position said side retaining members of said first and second wire side members therethrough; wherein said side retaining member of said first side wire member and said side retaining member of said second side wire member when positioned within the openings of said first and second ends of said base place said rim members of said side wire members in a spaced relation effective to maintain the flexible bag in an open condition when installed thereon.

The rack described above can be provided with a cover assembly which adds further rigidity to the overall structure and facilitates the use of the rack in recycling applications. The cover assembly may optionally be provided with a cover plate which provides a surface for placing a message thereon for instructing persons on the proper use of the apparatus.

The rack can also be fabricated having a base wherein inward from each of the first and second ends of the base is a second upper base member and a second lower base member positioned so as to define a second opening effective to position the side retaining members of the first and second wire side members therethrough, the second upper and lower base members capable of effecting a snap-lock fit with the side retaining members.

The rack of the present invention is easily and inexpensively manufactured and designed for use with low cost plastic bags, making the combination particularly suitable for recycling applications. The rack can be used as a free-standing recycling station.

Therefore it is an object of the present invention to provide a rack for supporting a flexible bag in an open condition.

It is another object of the present invention to provide a rack which facilitates the collection of recyclable materials.

It is a further object of the present invention to provide a rack for use in the collection of recyclable materials which may be shipped in a collapsed condition and easily assembled by a subsequent user.

Other objects and the several advantages of the present invention will become apparent to those skilled in the art upon a reading of the specification and the claims appended thereto.

BRIEF DESCRIPTION OF THE DRAWINGS

Reference may now be had to the following detailed description of an exemplary embodiment of the inventive rack taken in conjunction with the accompanying drawings, in which.

DETAILED DESCRIPTION OF THE INVENTION

The present invention is best understood by reference to the appended figures, which are given by way of example and not of limitation.

Figure 1:
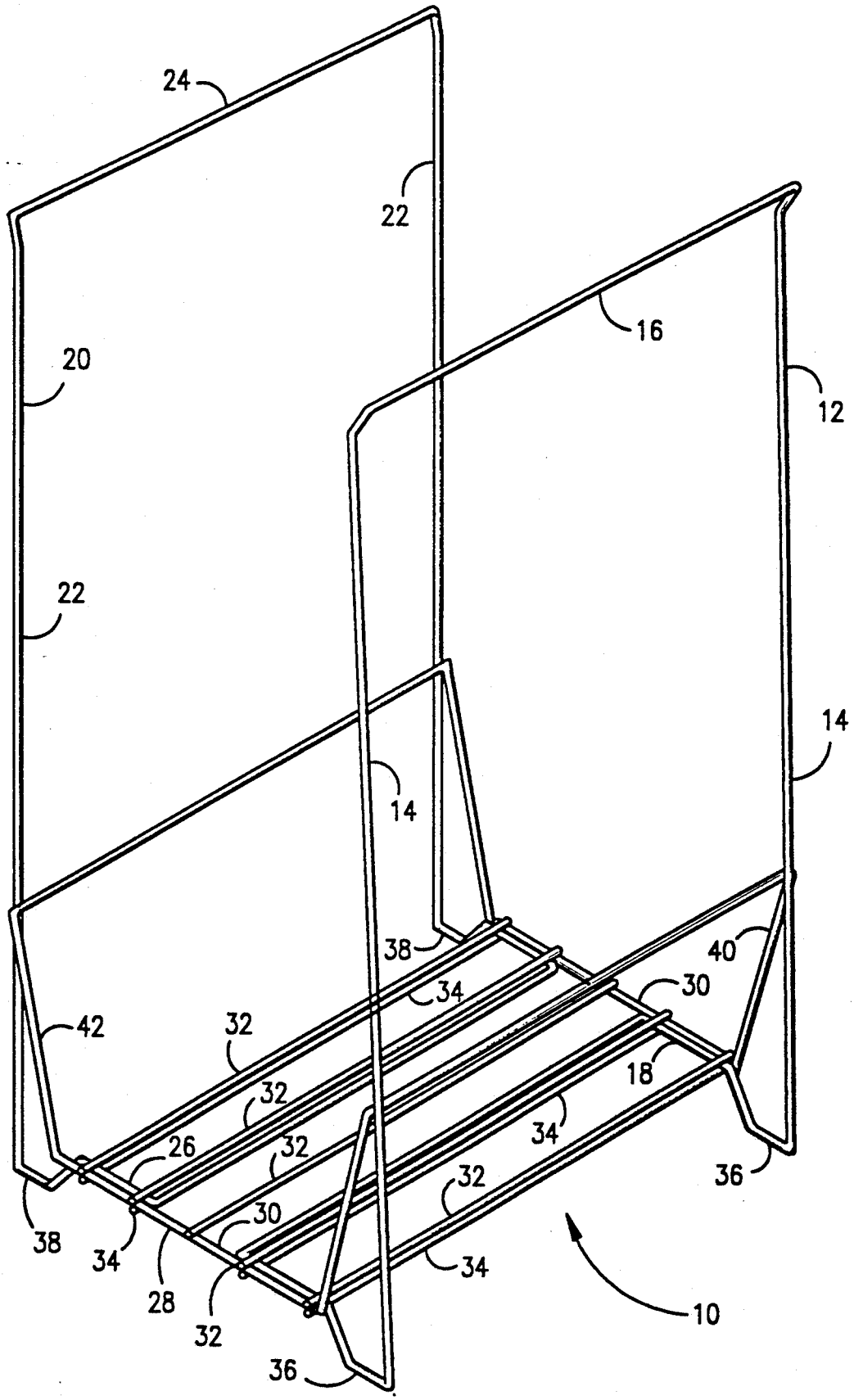
FIG. 1 presents a view in perspective of an embodiment of a rack for supporting a flexible bag in an open condition, in accordance with the present invention.

Referring now to FIG. 1, a perspective view of one embodiment of a rack 10 for supporting a bag in an open condition is shown. Rack 10 includes a first wire side member 12 having at least two upwardly standing spaced elongated wire members 14 each having an upper end and a lower end. The first wire side member 12 also includes a rim member 16 integrally connected to the upper ends of upwardly standing elongated wire members 14. As is preferred, rim member 16 extends outwardly from a plane defined by wire members 14. A side retaining member 18 is integrally connected to the lower ends of upwardly standing elongated wire members 14. Side retaining member 18 extends inwardly in a substantially horizontal plane. As is particularly preferred, side retaining member 18 may further include foot members 36 at opposite ends thereof and adjacent to the lower ends of each upwardly standing wire member 14.

Rack 10 also includes a second wire side member 20 which, as is preferred, may be substantially similar to the first wire side member 12, described above, or incorporate additional features as required by the particular application. In its simplest form, second wire side member 20 includes at least two upwardly standing spaced elongated wire members 22 each having an upper end and a lower end. Second wire side member 20 also includes rim member 24 integrally connected to the upper ends of upwardly standing elongated wire members 22. As was the case with the first wire side member 12, rim member 24 of second wire side member 20 extends outwardly from a plane defined by wire members 22. Side retaining member 26 is integrally connected to the lower ends of upwardly standing elongated wire members 22. Side retaining member 26 extends inwardly, in a substantially horizontal plane. When employed in the fabrication of first wire side member 12, side retaining member 26 may further include foot members 38 at opposite ends thereof and adjacent to the lower ends of each upwardly standing wire member 22.

Still referring to FIG. 1, rack 10 may be seen to further include a base 28 having a first end and a second end, base 28 having at least two spaced longitudinally disposed wire members 30 each having an upper tangential surface and a lower tangential surface. Base 28 also includes a plurality of upper base members 32 each affixed at opposite ends in a substantially perpendicular relationship to the upper tangential surfaces of the longitudinally disposed wire members 30. A plurality of lower base members 34 are each affixed at opposite ends, again, in a substantially perpendicular relationship, to the lower tangential surfaces of longitudinally disposed wire members 30. As may be appreciated by further reference to FIG. 5, the first and second ends of base 28 each have an upper base member 32 and a lower base member 34 positioned so as to define an opening at each of the first and second ends, the openings effective to position side retaining members 12 and 20 of first and second wire side members 12 and 20 therethrough.

As is preferred, the rack components described above, and in further detail hereinbelow, are constructed of wire stock, such as ¼-inch cold rolled steel. The wire stock may optionally be plated with materials such as chrome, nickel, brass, or the like to protect the outer surfaces from corrosion and provide a more attractive appearance to the resulting rack structure. The wire stock can be bent into the configurations depicted herein from long strands of such stock, be made from shorter straight sections of such stock and welded to form the configurations depicted or, as would be most likely, from a combination of bending and welding operations, as those skilled in the art will readily understand.

As may readily be appreciated, the preferred design of the rack of the present invention provides an assembly which can be advantageously assembled without the use of tools since side retaining members 18 and 26 of first and second wire members 12 and 20 are designed to slidingly engage the openings of the first and second ends of base 28. As is particularly preferred and shown in Fig. 1, in addition to the corresponding pair of an upper base member 32 and a lower base member 34 which defines an opening at the first end of base 28 for positioning side retaining member 18 therethrough and the corresponding pair of an upper base member 32 and a lower base member 34 which defines an opening at the second end of base 28 for positioning side retaining member 26 therethrough, second corresponding pairs of upper base members 32 and lower base members 34 may be provided to further support and secure side retaining members 18 and 26 of first and second wire side members 12 and 20, respectively, when rack 10 is assembled. It is most particularly preferred to provide each second corresponding pair of upper base members 32 and lower base members 34 with the ability to effect a snap-lock fit with side retaining members 18 and 26 as side retaining members 18 and 26 are positioned through their respective second corresponding pairs. As those skilled in the art will readily appreciate, the aforementioned ability to effect a snap-lock fit can be achieved by providing a slight inward bow to the upper base members 32 of the second corresponding pairs, by providing a slight inward bow to the lower base members 34 of the second corresponding pairs, by providing a slight inward bow to both the upper base members 32 and the lower base members 34 of the second corresponding pairs, by adding more pressure to the cross-wire welding of the upper base members 32 and the lower base members 34 to the two spaced longitudinally disposed wire members 30 at the second corresponding pairs, or any other method known to reduce the distance between the upper base members 32 and the lower base members 34 of the second corresponding pair so as to effect the aforementioned snap-lock fit.

Enhanced structural rigidity is achieved by providing first and second wire side members 12 and 20 with rigidifying members 40 and 42, respectively. As shown in FIG. 1, rigidifying members 40 and 42, are each angularly disposed from their respective side retaining member 18 or 26, to upwardly standing elongated wire members 14 or 22.

Figure 2:
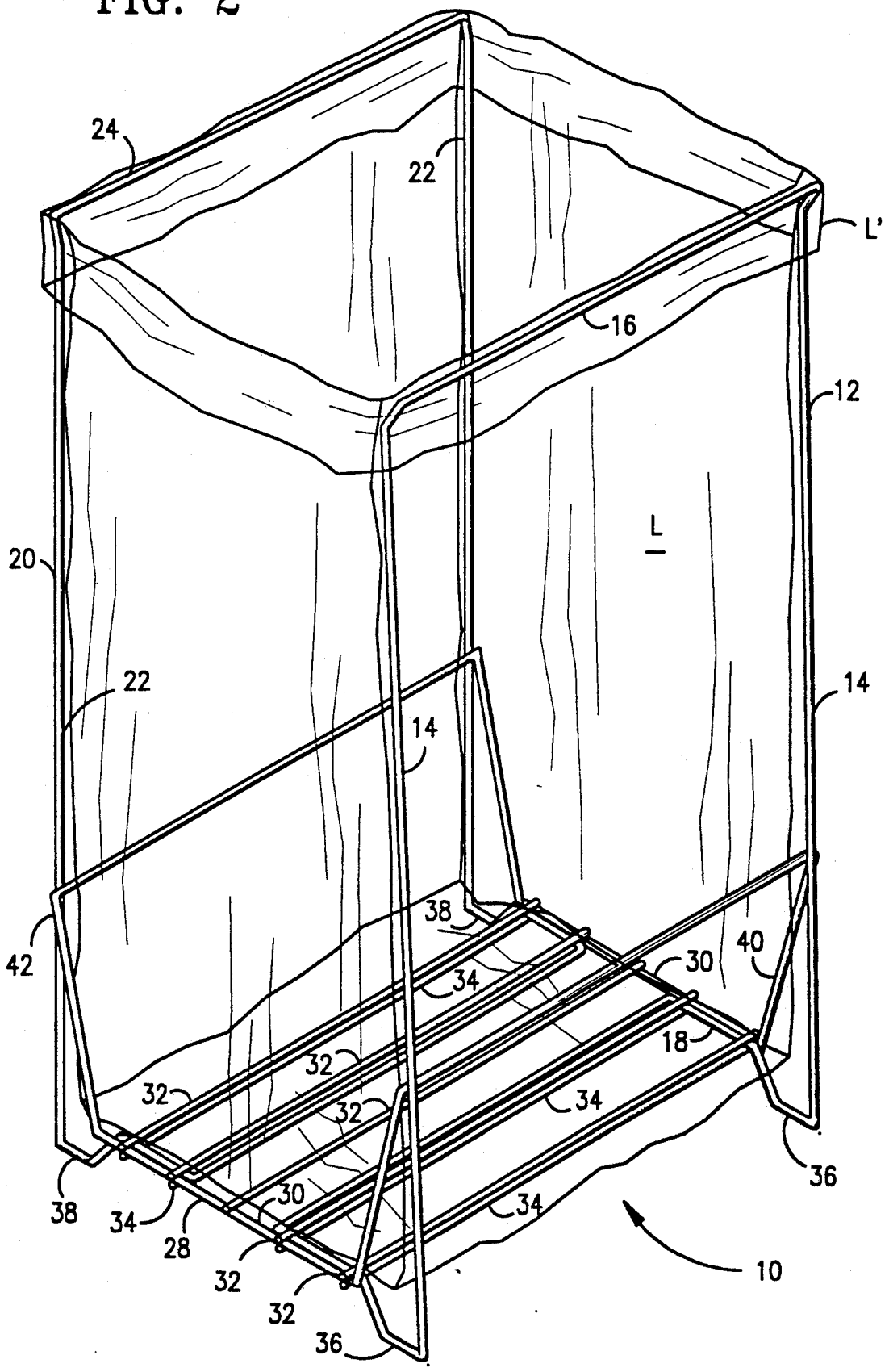
FIG. 2 presents a view in perspective of the rack of FIG. 1, shown supporting a transparent flexible thermoplastic bag in an open condition, in accordance with the present invention.

Referring now to FIG. 2, a view in perspective of the rack of FIG. 1, is shown supporting a transparent flexible thermoplastic bag L in an open condition. As can be envisioned, when said side retaining member 18 of first side wire member 12 and side retaining member 26 of second side wire member 20 are positioned within the openings of the first and second ends of base 28, rim members 16 and 24 are placed in a spaced relation effective to maintain flexible bag or liner L in an open condition when installed thereon. To install bag L on rack 10, the bag L is placed in the center of rack 10 and the bag lip L' stretched and folded over rim members 16 and 24. As may be appreciated, an inwardly directed force (to the center of rack 10) exerted by the stretched bag provides further rigidity to the overall structure of rack 10 when in use.

Figure 3:
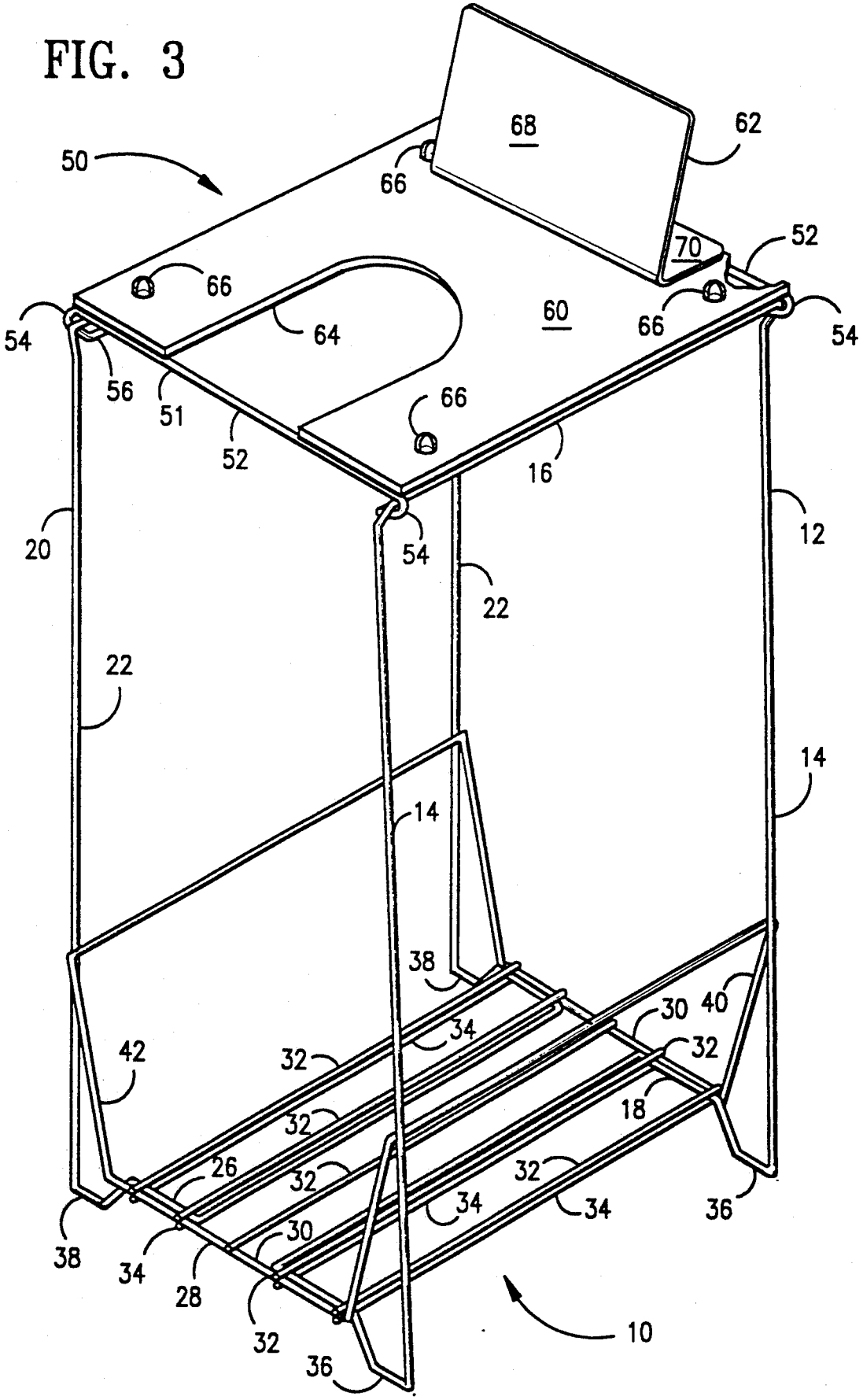
FIG. 3 presents a perspective view of an embodiment of a rack for collecting recyclable materials having a message board mounted thereon, in accordance with the present invention.

FIG. 3 presents a perspective view of an embodiment of a rack for collecting recyclable materials having a message board mounted thereon, in accordance with the present invention. The rack for collecting recyclable materials of FIG. 3 comprises, as is preferred, the rack 10 described in detail, above, and a cover assembly 50. Cover assembly 50 includes a frame 51 which itself includes at least two spaced longitudinally disposed rail members 52, each rail member having a hooked end 54 for engagement with a rim member 16 or 24 of the first or second wire side members 12 or 20, respectively, each hooked end 54 having an upper portion and lower portion, the upper portions of which are traversed by an integrally connected upper support member 58, the lower portions traversed by an integrally connected lower support member 56. (See FIG. 5). Cover assembly 50 also includes, as is preferred, a cover plate 60, affixed to the wire structure described above. A preferred method for affixing cover plate 60 is through the provision of wire pins 78, welded to the upper support members 58. (See FIG. 7 to view this feature). Holes are provided through cover plate 60 in alignment with wire pins 78, with locking caps 66 provided to secure cover plate 60 to the wire structure of cover assembly 50.

To aid in the collecting of recyclable materials, the opening at the top of the rack is reduced in cross-section, having an opening 64 which is sized to enable the collection of desired articles, but not so large as to encourage the "dumping" of a wide variety of undesired materials. Moreover, this arrangement provides an area large enough for the placement of an instructional message thereon, further aiding the object of collecting only those articles desired, i.e., plastic grocery sacks. To further enhance recycling efforts, a message board 62 is provided in a particularly preferred embodiment. Message board 62, which includes a substantially upright section 68 and a horizontally disposed mounting section 70, can be mounted to cover plate 60 through the use of common screws 72 and wing nuts 74 (see FIG. 7), or in any well known manner.

As can be appreciated by those skilled in the art, a wide variety of materials can be employed to fabricate cover plate 60 and message board 62. These include, but are not limited to, wood, sheet metal, e.g. aluminum, steel and the like, fiberboard and plastics, e.g. polystyrene, polypropylene, expanded polyvinyl chloride (PVC), acrylonitrile-butadiene styrene (ABS), and the like.

Figure 4:
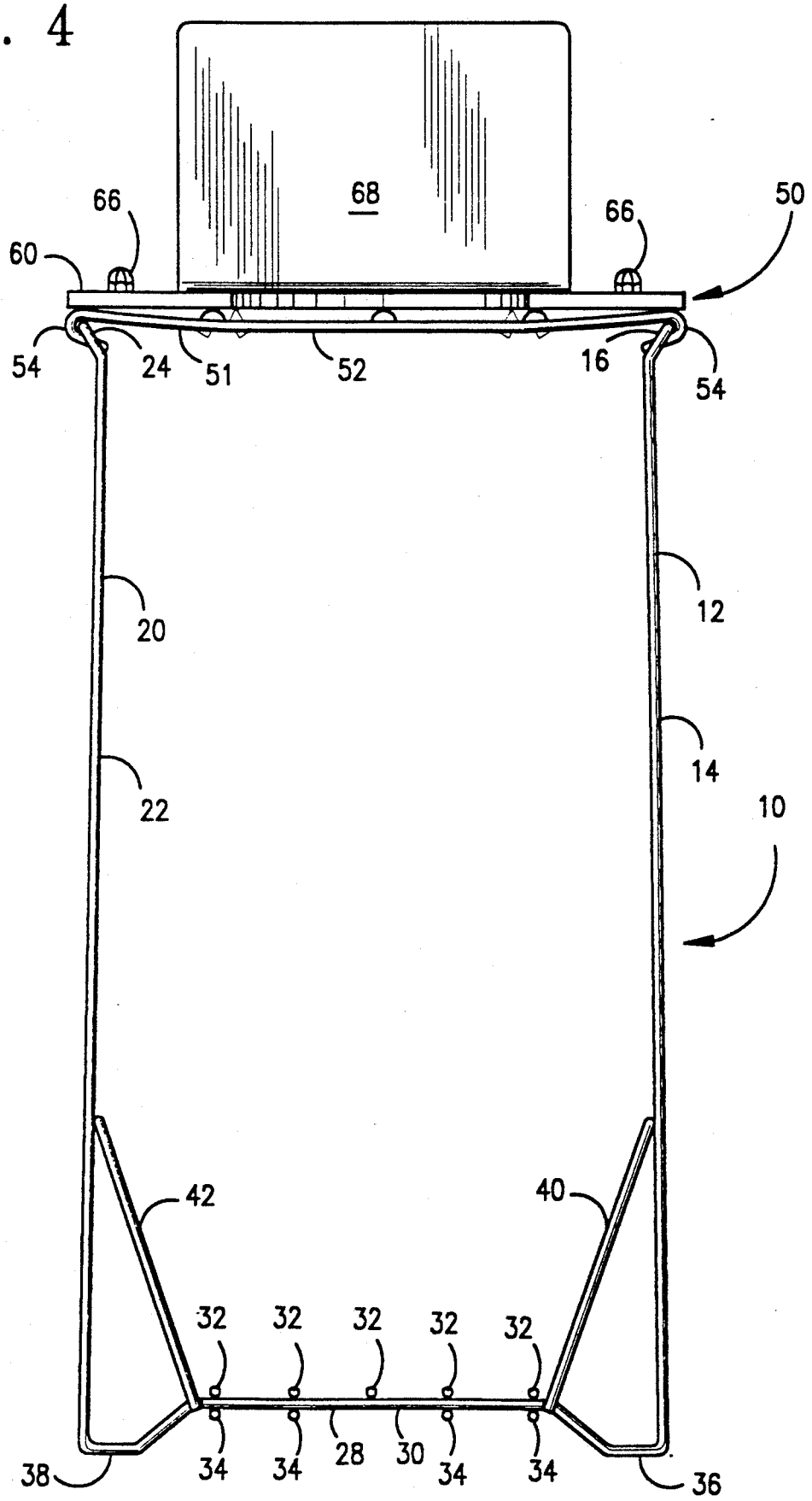
FIG. 4 presents a front plan view of the rack embodiment of FIG. 3.

FIG. 4 presents a front plan view of the rack embodiment of FIG. 3. In particular, FIG. 4 demonstrates the manner in which the hooked ends 54 of longitudinally disposed rail members 52 of cover assembly 50 engage with rim members 16 and 24 of first and second wire side members 12 and 20, respectively, for securement thereto. Additional details concerning the interrelation of first and second wire side members 12 and 20 and base 28 may be readily envisioned by reference to FIG. 4.

Figure 5:
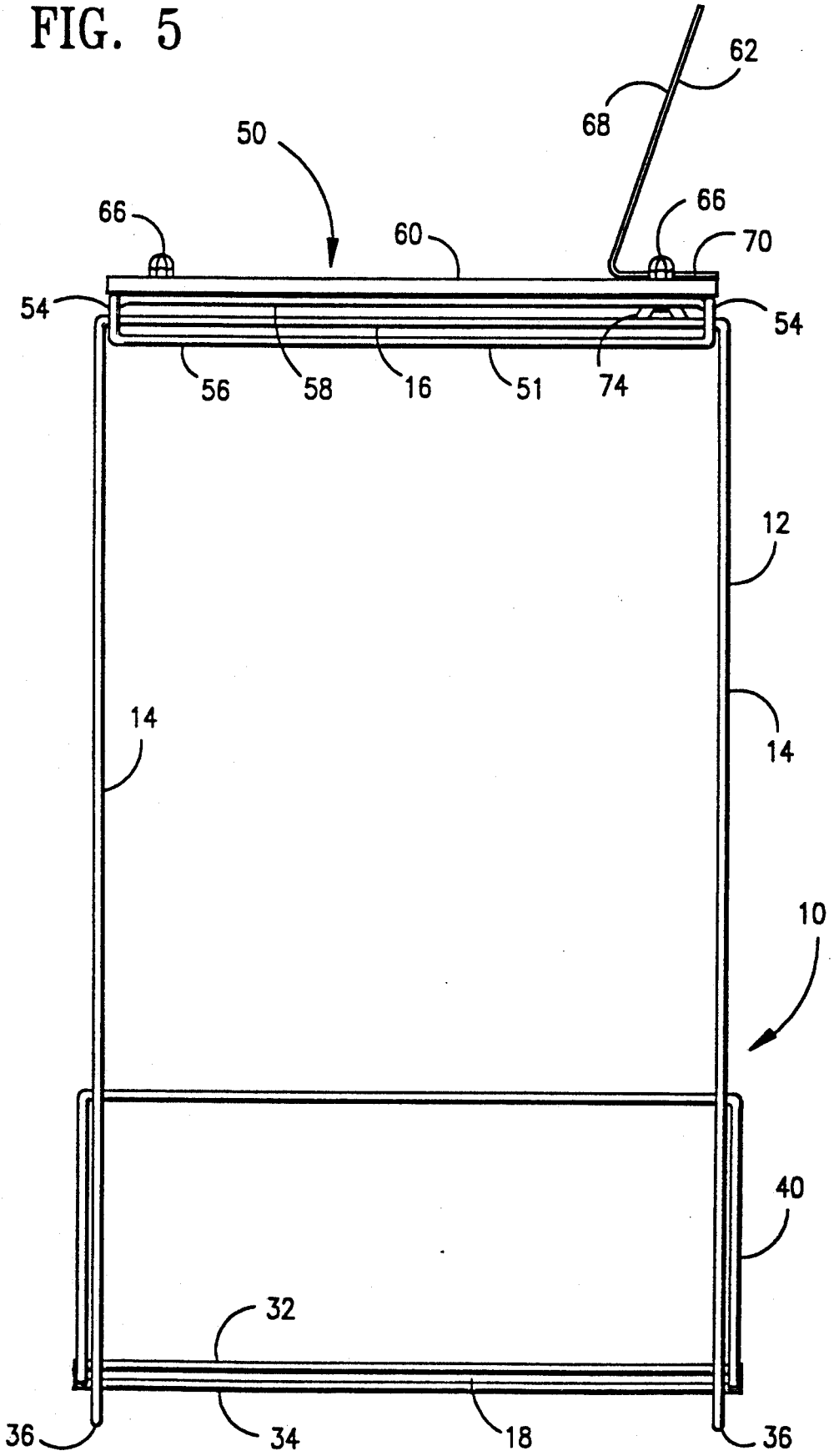
FIG. 5 shows a side plan view of the FIG. 3 plastic bag recycling rack embodiment.

FIG. 5 shows a side plan view of the FIG. 3 recycling rack embodiment. In particular, FIG. 5 shows the engagement of side retaining member 18 of first side wire member 12 within the opening at the first end of base 28, the opening formed by the cooperation of upper base member 32 and lower base member 34. Also, FIG. 5 demonstrates the interrelation of rim member 16 of first wire side member 12 with hooked ends 54, optional upper support member 58 and lower support member of frame 51.

Figure 6:
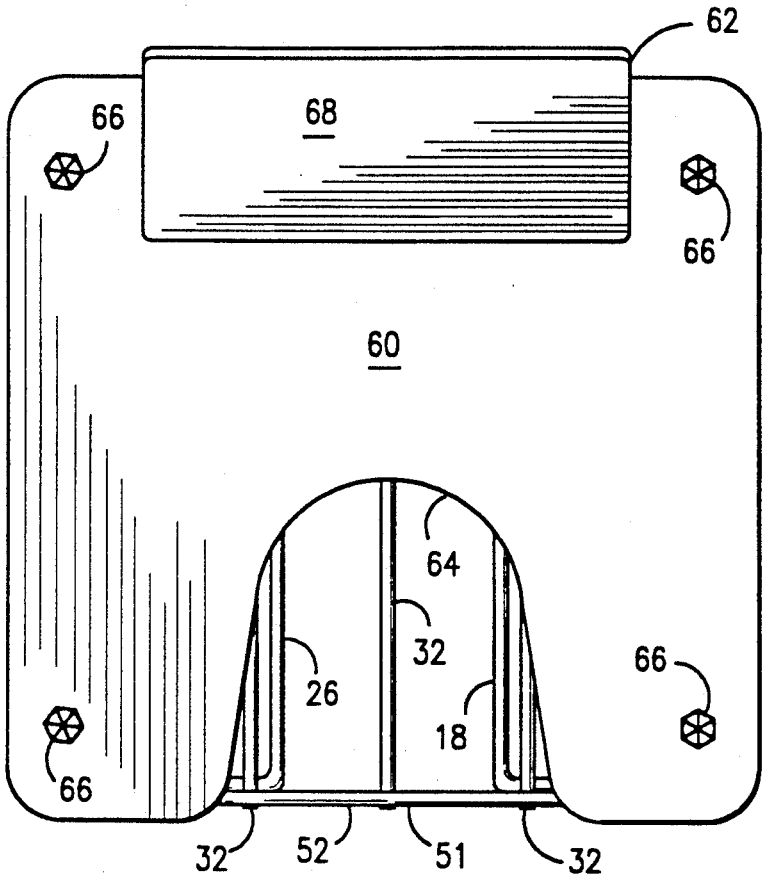
FIG. 6 presents a top plan view of the embodiment of FIG. 3.

FIG. 6 presents a top plan view of the embodiment of FIG. 3. As indicated above, to aid in the collecting of recyclable materials, the opening at the top of the rack is reduced in cross-section, having an opening 64 which is sized to enable the collection of the desired articles, but not so large as to encourage the dumping of a wide range of undesired materials. Shown in FIG. 6 is the relative cross-sectional opening employed when plastic grocery sacks are the targeted article for collection. This configuration provides an area large enough for the placement of an instructional message thereon, further aiding the object of collecting only those articles desired. For example, a message requesting that consumers remove paper-based grocery receipts prior to placing their plastic grocery sacks within the recycling rack of the present invention may be advantageously placed thereon. Message board 62 is also shown in FIG. 6.

Figure 7:
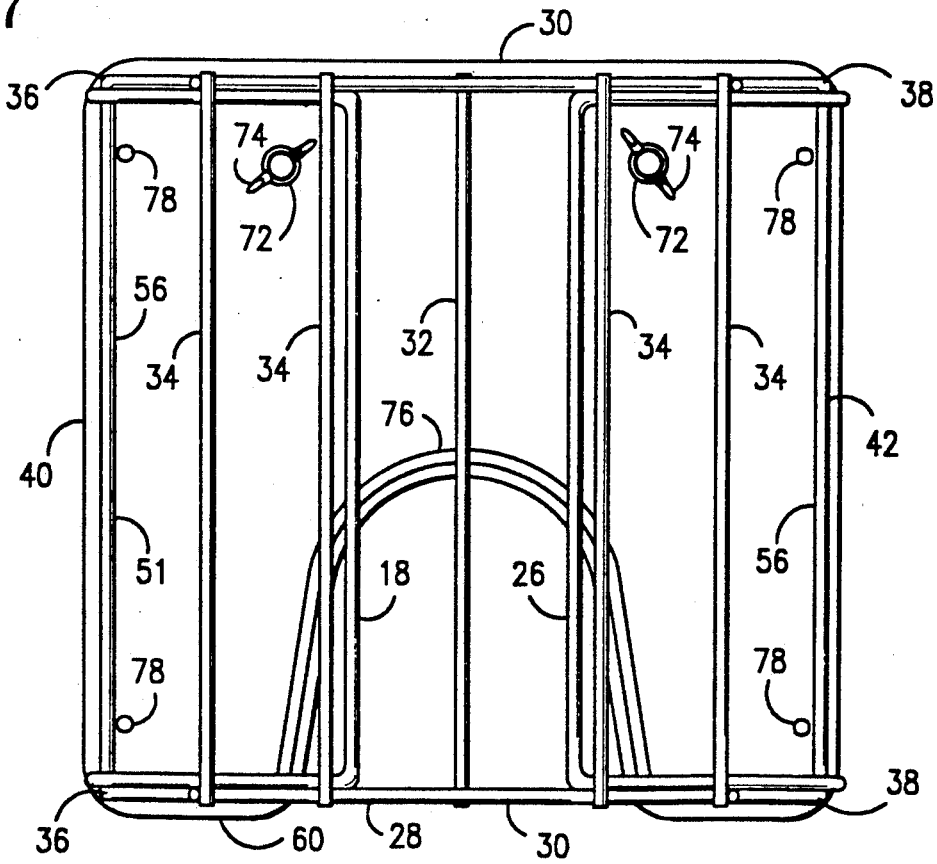
FIG. 7 presents a bottom plan view of the embodiment of FIG. 3.

FIG. 7 presents a bottom plan view of the embodiment of FIG. 3. FIG. 7 shows a preferred method for mounting message board 62, which includes the use of common screws 72 and wing nuts 74. Also shown in FIG. 7 are wire pins 78 which are affixed to upper support members 58, preferably through welding, and used to secure cover plate 60 to wire frame 51 of cover assembly 50 through the use of locking caps (see FIG. 6).

Figure 8:
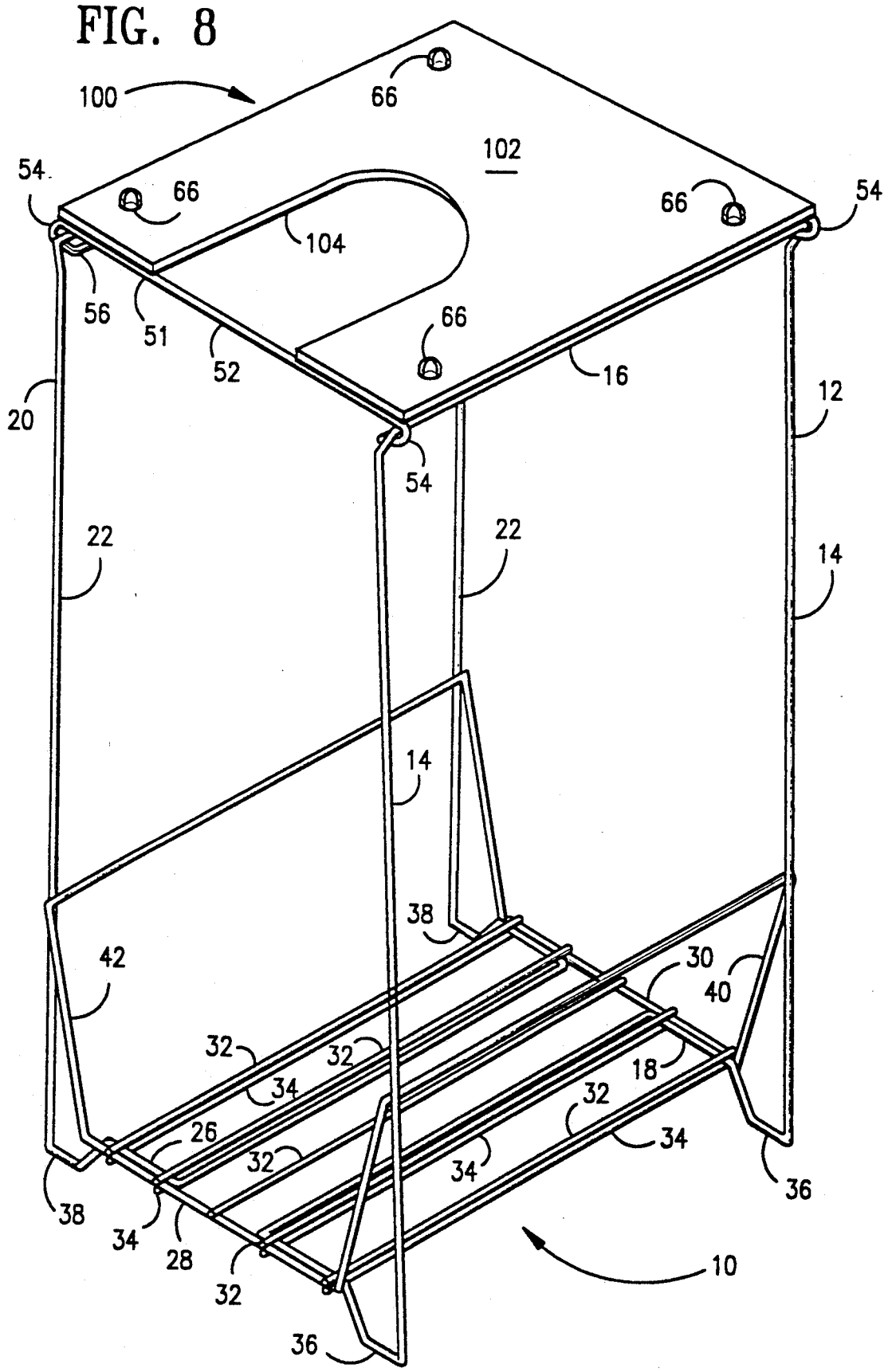
FIG. 8 presents a perspective view of an alternate embodiment of a rack for collecting recyclable materials, in accordance with the present invention.

FIG. 8 presents a perspective view of an alternate embodiment of a rack for collecting recyclable materials, in accordance with the present invention. In FIG. 8, like reference numerals denote like elements and assemblies. As may be seen, the primary difference between the embodiment of FIG. 8 and that of FIG. 3 is that cover assembly 100 does not have a message board mounted upon cover plate 102. Cover plate 102 is provided with an opening 104, sized to facilitate the collection of the targeted articles. Consistent with the embodiment of FIG. 3, opening 104 is preferably not so large as to encourage the dumping of a wide range of undesired materials.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims.

What is claimed is:

1. A rack for supporting flexible bags in an open condition, comprising:

(a) a first wire side member having at least two upwardly standing spaced elongated wire members each having an upper end and a lower end, a rim member integrally connected to said upper ends of said upwardly standing elongated wire members extending outwardly therefrom, and a side retaining member integrally connected to said lower ends of said upwardly standing elongated wire members;

(b) a second wire side member having at least two upwardly standing spaced elongated wire members each having an upper end and a lower end, a rim member integrally connected to said upper ends of said upwardly standing elongated wire members extending outwardly therefrom, and a side retaining member integrally connected to said lower ends of said upwardly standing elongated wire members; and (c) a base having a first end and a second end, said base comprising at least two spaced longitudinally disposed wire members each having an upper tangential surface and a lower tangential surface, a plurality of upper base members each affixed at opposite ends thereof in a substantially perpendicular relationship to said upper tangential surfaces of said longitudinally disposed wire members and a plurality of lower base members each affixed at opposite ends thereof in a substantially perpendicular relationship to said lower tangential surfaces of said longitudinally disposed wire members, said first and second ends of said base each having an upper base member and a lower base member positioned so as to define an opening at each of said first and second ends effective to position said side retaining members of said first and second wire side members therethrough;

wherein said side retaining member of said first side wire member and said side retaining member of said second side wire member when positioned within the openings of said first and second ends of said base place said rim members of said side wire members in a spaced relation effective to maintain the flexible bag in a open condition when installed thereon, and inward from each of said first and second ends of said base is a second upper base member and a second lower base member positioned so as to define a second opening effective to position said side retaining members of said first and second wire side members therethrough, said second upper and lower base members capable of effecting a snap-lock fit with said side retaining members.

2. The rack of claim 1, wherein said base includes five equally spaced upper base members affixed in a substantially perpendicular relationship to said upper tangential surfaces of said longitudinally disposed wire members and four lower base members affixed in a substantially perpendicular relationship to said lower tangential surfaces of said longitudinally disposed wire members.

3. The rack of claim 1, further comprising a cover assembly, said cover assembly having a frame which includes at least two spaced longitudinally disposed rail members, each said rail member having a hooked end at opposite ends thereof for engagement with said rim member of said wire side members, each hooked end having an upper portion and lower portion, said lower portions traversed by an integrally connected lower support member.

4. The rack of claim 3, wherein said cover assembly further comprises a cover plate affixed to said frame.

5. The rack of claim 4, wherein said cover assembly further comprises a message board affixed to said cover plate.

6. The rack of claim 5, wherein said side retaining members each include at opposite ends thereof a foot member adjacent to s id lower ends of said upwardly standing elongated wire members.

7. The rack of claim 1, wherein said side retaining members each include at opposite ends thereof a foot member adjacent to said lower ends of said upwardly standing elongated wire members.

8. The rack of claim 7, wherein said side retaining members each include a rigidifying member angularly disposed from said side retaining member to said upwardly standing elongated wire members.

9. The rack of claim 1, wherein said side retaining members each include a rigidifying member angularly disposed from said side retaining member to said upwardly standing elongated wire members.

10. A rack for collecting recyclable materials, comprising:

(a) a first wire side member having at least two upwardly standing spaced elongated wire members each having an upper end and a lower end, a rim member integrally connected to said upper ends of said upwardly standing elongated wire members extending outwardly therefrom, and a side retaining member integrally connected to said lower ends of said upwardly standing elongated wire members;

(b) a second wire side member having at least two upwardly standing spaced elongated wire members each having an upper end and a lower end, a rim member integrally connected to said upper ends of said upwardly standing elongated wire members extending outwardly therefrom, and a side retaining member integrally connected to said lower ends of said upwardly standing elongated wire members;

(c) a base having a first end and a second end, said base comprising at least two spaced longitudinally disposed wire members each having an upper tangential surface and a lower tangential surface, a plurality of upper base members each affixed at opposite ends thereof in a substantially perpendicular relationship to said upper tangential surfaces of said longitudinally disposed wire members and a plurality of lower base members each affixed at opposite ends thereof in a substantially perpendicular relationship to said lower tangential surfaces of said longitudinally disposed wire members, said first and second ends of said base each having an upper base member and a lower base member positioned so as to define an opening at each of said first and second ends effective to position said side retaining members of said first and second wire side members therethrough; and (d) a cover assembly, said cover assembly comprising a frame which includes at least two spaced longitudinally disposed rail members, each said rail member having a hooked end at opposite ends thereof for engagement with said rim member of said wire side members, each hooked end having an upper portion and lower portion, said lower portions traversed by an integrally connected lower support member; and a cover plate affixed to said frame;

wherein said side retaining member of said first side wire member and said side retaining member of said second side wire member when positioned within the openings of said first and second ends of said base place said rim members of said side wire members in a spaced relation effective to maintain the flexible bag in an open condition when installed thereon.

11. The recycling rack of claim 10, wherein inward from each of said first and second ends of said base is a second upper base member and a second lower base member positioned so as to define a second opening effective to position said side retaining members of said first and second wire side members therethrough, said second upper and lower base members capable of effecting a snap-lock fit with said side retaining members.

12. The recycling rack of claim 11, wherein said cover assembly further comprises a message board affixed to said cover plate.

13. The recycling rack of claim 12, wherein said side retaining members each include at opposite ends thereof a foot member adjacent to said lower ends of said upwardly standing elongated wire members.

14. The recycling rack of claim 11, wherein said side retaining members each include at opposite ends thereof a foot member adjacent to said lower ends of said upwardly standing elongated wire members.

15. The recycling rack of claim 13, wherein said side retaining members each include a rigidifying member angularly disposed from said side retaining member to said upwardly standing elongated wire members.

16. The recycling rack of claim 11, wherein said side retaining members each include a rigidifying member angularly disposed from said side retaining member to said upwardly standing elongated wire members.

17. The recycling rack of claim 10, wherein said side retaining members each include a rigidifying member angularly disposed from said side retaining member to said upwardly standing elongated wire members.

18. The recycling rack of claim 15, wherein said base includes five equally spaced upper base members affixed in a substantially perpendicular relationship to said upper tangential surfaces of said longitudinally disposed wire members and four lower base members affixed in a substantially perpendicular relationship to said lower tangential surfaces of said longitudinally disposed wire members.

19. The recycling rack of claim 11, wherein said base includes five equally spaced upper base members affixed in a substantially perpendicular relationship to said upper tangential surfaces of said longitudinally disposed wire members and four lower base members affixed in a substantially perpendicular relationship to said lower tangential surfaces of said longitudinally disposed wire members.

* * * * *